US006334470B2

(12) United States Patent
Healy

(10) Patent No.: US 6,334,470 B2
(45) Date of Patent: Jan. 1, 2002

(54) COAXIAL VAPOR FLOW INDICATOR WITH PUMP SPEED CONTROL

(75) Inventor: James W. Healy, Hollis, NH (US)

(73) Assignee: Healy Systems, Inc., Hudson, NH (US)

( * ) Notice: Subject to any disclaimer, the term of this patent is extended or adjusted under 35 U.S.C. 154(b) by 0 days.

(21) Appl. No.: 09/732,157

(22) Filed: Dec. 7, 2000

Related U.S. Application Data

(60) Division of application No. 09/633,090, filed on Aug. 4, 2000, which is a continuation-in-part of application No. 09/272,479, filed on Mar. 19, 1999, and a continuation-in-part of application No. PCT/US99/01932, filed on Mar. 18, 1999

(60) Provisional application No. 60/154,617, filed on Sep. 17, 1999.

(51) Int. Cl.[7] ..... B67D 5/00

(52) U.S. Cl. ..... 141/59; 141/7; 141/94; 141/290

(58) Field of Search ..... 141/7, 59, 94, 141/290

(56) References Cited

U.S. PATENT DOCUMENTS

| | | | | |
|---|---|---|---|---|
| 1,889,705 | A | 11/1932 | Sherwood | 73/861.57 |
| 4,581,944 | A | 4/1986 | Obermann et al. | 73/861.47 |
| 4,646,940 | A | 3/1987 | Kramer et al. | 222/1 |
| 5,038,838 | A | 8/1991 | Bergamini | 141/59 |
| 5,040,577 | A | 8/1991 | Pope | 141/59 |
| 5,156,199 | A | 10/1992 | Hartsell, Jr. et al. | 141/83 |
| 5,269,353 | A | 12/1993 | Nanji et al. | 141/59 |
| 5,273,087 | A | 12/1993 | Koch et al. | 141/94 |
| 5,390,712 | A | 2/1995 | Parrish et al. | 141/59 |
| 5,450,883 | A | 9/1995 | Payne et al. | |
| 5,507,325 | A | 4/1996 | Finlayson | 141/83 |
| 5,671,785 | A | 9/1997 | Anderson | 141/59 |

OTHER PUBLICATIONS

International Search Report for US/PCT00/40906 (dated Jan. 2, 2001).

*Primary Examiner*—J. Casimer Jacyna
(74) *Attorney, Agent, or Firm*—Fish & Richardson P.C.

(57) ABSTRACT

A vacuum assist vapor recovery system for a fuel dispensing system having a coaxial hose with an outer fuel conduit for delivery of fuel and an inner vapor conduit for recovery of vapor, and such a fuel dispensing system includes an indicator assembly for providing indication of vapor flow reduction in the inner vapor conduit. The indicator assembly has a detector element in communication with the inner vapor conduit for detection of vapor flow within the inner vapor conduit and an indicator element of vapor flow for indication of vapor flow and vapor flow reduction within the inner vapor conduit detected by the detector element. The detector element includes a Venturi device disposed in communication with the inner vapor conduit, a diaphragm responsive to the pressure between the Venturi throat and the upstream inner vapor passageway, and a magnet associated with, i.e., reflecting the movement of, the diaphragm. The indicator element consists of a signal indicative of the vapor flow rate from a Hall Effect device.

2 Claims, 7 Drawing Sheets

COAXIAL VAPOR FLOW INDICATOR WITH PUMP SPEED CONTROL

This application is a division of U.S. Ser. No. 09/633,090, filed Aug. 4, 2000, and now pending, which is a continuation-in-part of U.S. Ser. No. 09/272,479, filed Mar. 19, 1999, and now pending, and a continuation-in-part of International Patent Application No. PCT/US99/01932, having an International filing date of Mar. 18, 1999, and now pending. This application also claims the benefit of U.S. Provisional Application No. 60/154,617, filed Sep. 17, 1999.

TECHNICAL FIELD

This invention relates to vapor flow indicators for fuel dispensing systems.

BACKGROUND

Systems for dispensing fuel into vehicles, e.g. at gasoline stations, typically employ a coaxial hose, which, in so-called inverted arrangement, has an outer conduit for delivery of fuel to the vehicle and an inner conduit for recovery of fuel vapors displaced from the vehicle tank. Recent field testing by the California Air Resources Board (CARB) of vacuum assist vapor recovery systems for use in fuel dispensing systems uncovered a problem with the inverted coaxial hose. They found that the internal vapor hose can kink during normal operation, causing substantial blockage of the vapor return pathway. Once kinked, these hoses tend to remain in a tube-collapsed condition, thus permanently reducing the cross sectional area of the vapor flow path.

Vacuum assist systems which employ a variable speed vane pump, or other flow control device mounted in the dispenser, use the electronic pulses related to the liquid gasoline flow rate to control the vane pump speed or the orifice size of a variable orifice restrictor. Using this technique, the volumetric rate of vapor recovery is maintained in proportion to the rate of liquid gasoline delivery.

A kink in the vapor hose will act to restrict vapor flow, thus changing the absolute pressure on the inlet side of the vapor flow control device. The reduction in pressure results in a reduction in throughput for both the vane pump and the variable orifice flow control device. A kink in the vapor hose can therefore result in escape of gasoline vapor in the vehicle tank fillpipe to the extent that the vapor recovery throughput is reduced at the flow control device.

In practice, the detection of a damaged vapor hose in the service station is not easy, since the outer hose might not show any physical sign of kinking. This type of defect can only be found through extensive testing or by a process of elimination of other vapor recovery related components.

SUMMARY

According to one aspect of the invention, a method for monitoring vapor-to-liquid flow rate in a fuel dispensing system with a vacuum assisted vapor recovery system having a coaxial hose with an outer fuel conduit for delivery of fuel and an inner vapor conduit for recovery of vapor comprises the steps of: determining vapor flow rate in the inner vapor conduit; issuing a signal indicative of the vapor flow rate; determining liquid fuel flow rate in the outer fuel conduit; issuing a signal indicative of the liquid fuel flow rate; comparing the signal indicative of the vapor flow rate and the signal indicative of the liquid fuel flow rate; and, when vapor-to-liquid flow rate is outside a predetermined range, issuing a signal.

Preferred embodiment of this aspect of the invention may include the following additional features. The method comprises the steps of: issuing the signal to adjust flow of vapor; comparing the signal indicative of the vapor flow rate and the signal indicative of the liquid fuel flow rate; and, if vapor-to-liquid flow rate remains outside a predetermined range, issuing a signal to further adjust flow of vapor. The method comprises the step of issuing the signal to adjust flow of vapor.

According to another aspect of the invention, a vacuum assist vapor recovery system for a fuel dispensing system having a coaxial hose with an outer fuel conduit for delivery of fuel and an inner vapor conduit for recovery of vapor comprises: an indicator assembly for providing indication of vapor flow reduction in the inner vapor conduit, the indicator assembly comprising a detector element in communication with the inner vapor conduit for detection of vapor flow within the inner vapor conduit and an indicator element of vapor flow for indication of vapor flow and vapor flow reduction within the inner vapor conduit detected by the detector element, the detector element comprising a Venturi device disposed in communication with the inner vapor conduit, a diaphragm responsive to the pressure between the Venturi throat and the upstream inner vapor passageway, and a magnet associated with, i.e. reflecting the movement of, the diaphragm, and the indicator element comprising a signal indicative of the vapor flow rate from a Hall Effect device.

According to still another aspect of the invention, a fuel dispensing system with a vacuum assisted vapor recovery system having a coaxial hose with an outer fuel conduit for delivery of fuel and an inner vapor conduit for recovery of vapor and further comprises an indicator assembly for providing indication of restriction of flow cross-section for the inner vapor conduit, the indicator assembly comprising a detector element in communication with the inner vapor conduit for detection of vapor flow within the inner vapor conduit and an indicator element of vapor flow for indication of vapor flow and detection of vapor flow reduction within the inner vapor conduit detected by the detector element, the detector element comprising a Venturi device disposed in communication with the inner vapor conduit, a diaphragm responsive to the pressure between the Venturi throat and the upstream inner vapor passageway, and a magnet associated with, i.e. reflecting the movement of, the diaphragm, and the indicator element comprising a signal indicative of the vapor flow rate from a Hall Effect device.

According to another aspect of the invention, a vacuum assist vapor recovery system, e.g. in or for a fuel dispensing system, having a coaxial hose with an outer fuel conduit for delivery of fuel and an inner vapor conduit for recovery of vapor comprises an indicator assembly for providing indication of vapor flow reduction in the inner vapor conduit, e.g., due to restriction of flow cross-section in the inner vapor conduit or failure of a vacuum pump or other vacuum control device, the indicator assembly comprising a detector element in communication with the inner vapor conduit for detection of vapor flow within the inner vapor conduit and an indicator element of vapor flow for indication of vapor flow within the inner vapor conduit detected by the detector element.

Preferred embodiments of the invention may include one or more of the following additional features. The indicator assembly further comprises a housing defining a chamber in communication with the inner vapor conduit, a paddle mounted to pivot in the chamber between a first position indicating relatively low or no flow and a second position indicating relatively higher flow, spring means biasing the paddle toward the first position, and a window for viewing into the chamber from external of the housing, the paddle having a first end portion disposed in a flow of vapor through the inner vapor conduit, the first end portion moved from the first position toward the second position by vapor flow in the inner vapor conduit for detection of vapor flow within the inner vapor conduit, and the paddle having a second end portion disposed in view of the window, the second end portion being moved from the first position toward the second position in response to movement of the first end portion in detection of flow of vapor for indication of vapor flow within the inner vapor conduit. The indicator assembly further comprises a housing defining a chamber in communication with the inner vapor conduit, a paddle wheel comprising a body with a plurality of paddles extending therefrom generally radially in a plane of rotation, the paddle wheel being mounted to rotate in the chamber in response to flow of vapor in the inner vapor conduit, and a window for viewing into the chamber from external of the housing, at any time, one or more of the plurality of paddles being disposed in a flow of vapor through the inner vapor conduit, the one or more paddles being moved and the paddle wheel being rotated by vapor flow in the inner vapor conduit for detection of vapor flow within the inner vapor conduit, and one or more other of the plurality of paddles being disposed in view of the window, the one or more other of the plurality of paddles being moved relative to the window in response to movement of the one or more paddles of the plurality of paddles in detection of flow of vapor for indication of vapor flow within the inner vapor conduit. The indicator assembly further comprises a module, the module being reversible 180E relative to the housing to permit alternative placement of the housing, including where vapor flows in an opposite direction. The detector element comprises a Venturi device disposed in communication with the upstream inner vapor conduit, the indicator assembly comprises a differential pressure gauge, and the indicator element comprises an electronic display of flow rate. The detector element comprises a Venturi device disposed in communication with the inner vapor conduit, the indicator assembly comprises a differential pressure transducer, and the indicator element comprises an electronic display of flow rate. The detector element comprises a paddle wheel comprising a body with a plurality of paddles extending therefrom generally radially in a plane of rotation with signal elements mounted to one or more of the paddles of the paddle wheel, and the indicator element comprises a proximity sensor responsive to the signal elements mounted upon the paddle wheel and an electronic display of flow rate. The indicator assembly further comprises a housing defining a chamber in communication with the inner vapor conduit and adapted for mounting vertically, and a float ball rotameter comprising a precision float ball disposed for movement between a lower pin and a spaced apart upper pin, the upper and lower pins defining a chamber therebetween, the precision float ball adapted to move in the chamber between a first position in proximity to the lower pin indicating relatively low or no flow and a second position in proximity to the upper pin indicating relatively higher flow, and a window for viewing into the chamber from external of the housing, the precision float ball being lifted from the first position toward the second position by vapor flow in the inner vapor conduit for detection of vapor flow within the inner vapor conduit, and movement of the precision float ball between first position and the second position in response to flow of vapor providing indication of vapor flow within the inner vapor conduit. The detector element comprises a Venturi device disposed in communication with the inner vapor conduit and a diaphragm responsive to a differential of pressure between the Venturi throat and the upstream inner vapor passageway, and the indicator element comprises a pointer associated with a scale and moveable relative to the scale in response to movement of the diaphragm. The detector element comprises a Venturi device disposed in communication with the inner vapor conduit, a diaphragm responsive to the pressure between the Venturi throat and the upstream inner vapor passageway, a magnet associated with, i.e. reflecting the movement of, the diaphragm, and an indicator element comprising a signal indicative of the vapor flow rate from a Hall Effect device. The detector element comprises a Venturi device disposed in communication with the inner vapor conduit and a differential vapor transducer responsive to a differential of pressure between the Venturi throat and the upstream inner vapor passageway, and the indicator element comprises a signal indicative of the vapor flow rate from the differential pressure transducer.

Preferred embodiments of a fuel dispensing system of the invention may also include one or more of the following additional features. The fuel dispensing system further comprises a comparator adapted to receive the signal indicative of vapor flow rate and a corresponding signal indicative of liquid flow rate. Preferably, the comparator is further adapted to issue a signal when vapor-to-liquid flow rate outside a predetermined range is directed. More preferably fuel dispensing system further comprises a signal receiver adapted to receive the signal issued by the comparator and discontinue flow of liquid fuel.

According to another aspect of the invention, a method for monitoring vapor-to-liquid flow rate in a fuel dispensing system with a vacuum assisted vapor recovery system having a coaxial hose with an outer fuel conduit for delivery of fuel and an inner vapor conduit for recovery of vapor comprises the steps of: determining vapor flow rate in the inner vapor conduit; issuing a signal indicative of the vapor flow rate; determining liquid fuel flow rate in the outer fuel conduit; issuing a signal indicative of the liquid fuel flow rate; comparing the signal indicative of the vapor flow rate and the signal indicative of the liquid fuel flow rate; and, when vapor-to-liquid flow rate is outside a predetermined range, issuing a signal.

Preferred embodiments of this aspect of the invention may also include one or more of the following additional features. The method comprises the steps of issuing the signal to adjust flow of vapor; comparing the signal indicative of the vapor flow rate and the signal indicative of the liquid fuel flow rate; and if vapor-to-liquid flow rate remains outside a predetermined range, issuing a signal to adjust flow of liquid fuel. The method comprises the step of issuing the signal to adjust, i.e. shut off, flow of liquid fuel.

An object of the invention is to provide a device for indication of vapor flow within the inner conduit of a coaxial fuel dispensing hose in order to detect restriction of the vapor flow path, e.g., due to kinking of the inner hose or faulty performance of the vapor flow control device or pump.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
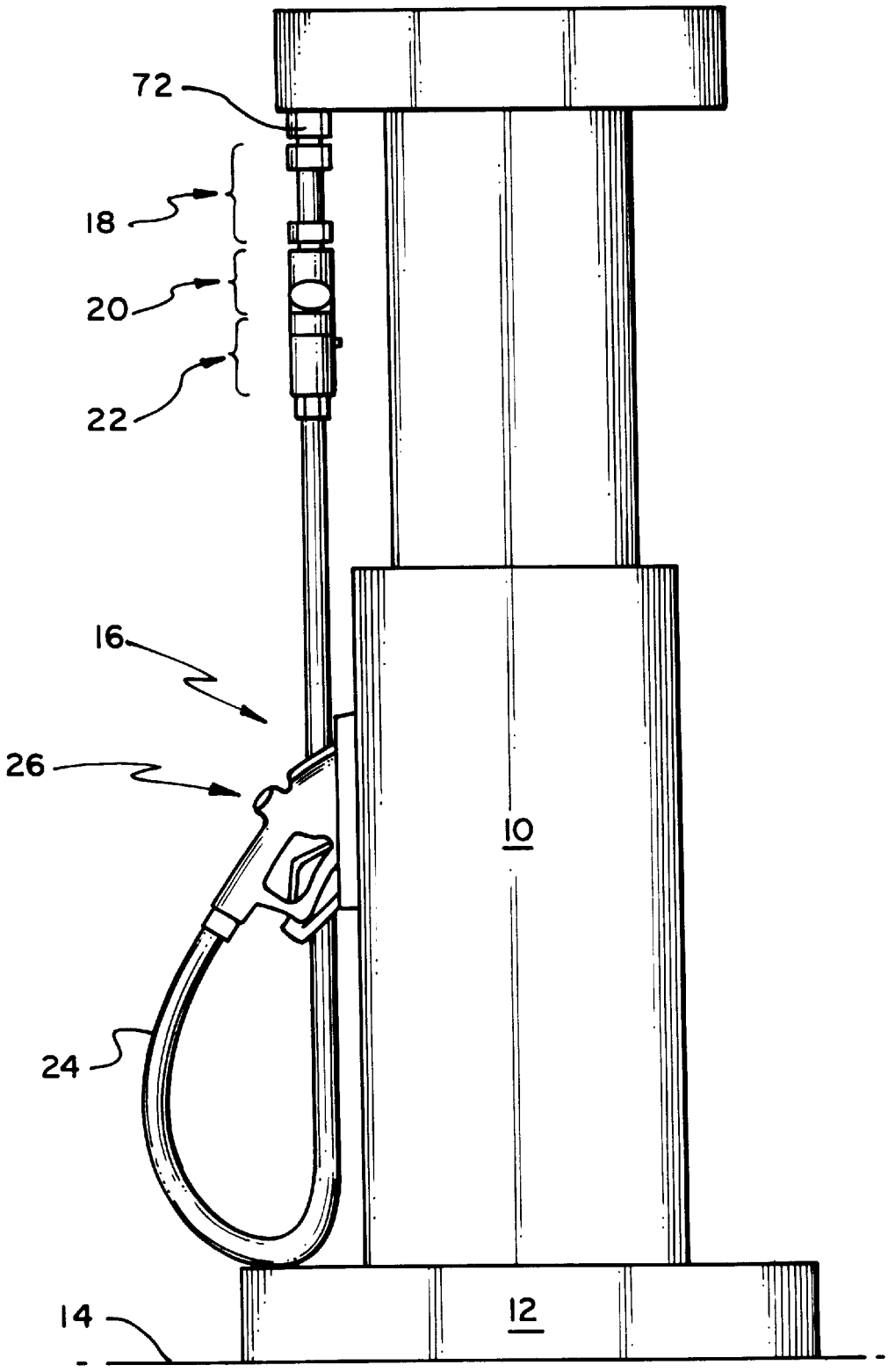
FIG. 1 is a somewhat diagrammatic view of one embodiment of a fuel dispensing system with a vacuum assist vapor recovery system and employing a coaxial vapor recovery flow indicator of the invention.

Referring to FIG. 1, a multi-product fuel dispenser 10 is mounted on an island 12 above a driving surface 14, e.g. at a typical gasoline or vehicle fueling station. Extending from the dispenser is a coaxial hose assembly 16 consisting of a coaxial whip hose 18, a coaxial vapor flow indicator 20 of the invention (to be described more fully below), a coaxial breakaway assembly 22, e.g. as described in my U.S. Pat. No. 5,297,574, and a segment of flexible coaxial hose 24, terminating in a fuel dispensing, vacuum assist vapor recovery nozzle 26.

Figure 2:
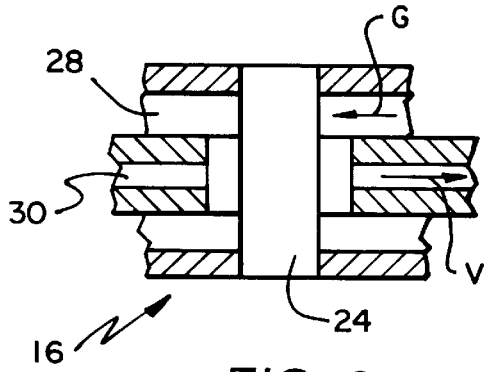
FIG. 2 is a side view, partially in section, of a coaxial hose for use in a fuel dispensing system, e.g., as shown in FIG. 1 (and also as shown in FIG. 3)

Referring to FIG. 2, the coaxial hose assembly 16 defines an outer conduit 28 for delivery of fuel, e.g. gasoline (arrow, G), to a vehicle, and an inner conduit 30 for vacuum assisted recovery of vapor (arrow, V) displaced from the vehicle fuel tank by delivery of fuel.

Figure 3:
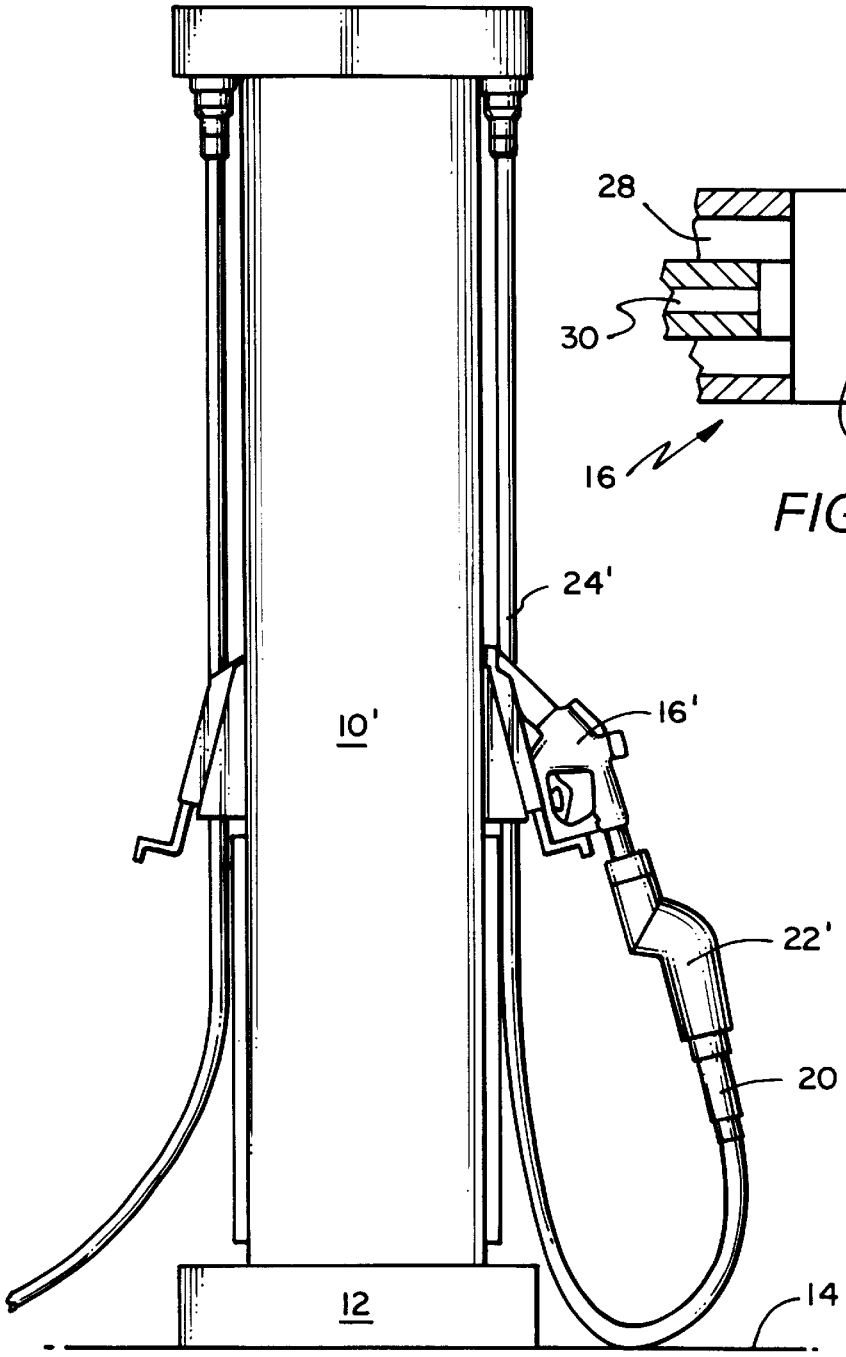
FIG. 3 is a somewhat diagrammatic view of another embodiment of a fuel dispensing system with a vacuum assist vapor recovery system and employing the coaxial vapor recovery flow indicator of FIG. 1.

Referring to FIG. 3, another multi-product fuel dispenser 10 is mounted on island 12 above driving surface 14. Extending from the dispenser is a coaxial hose assembly 16' consisting of a coaxial hose 24', a coaxial vapor flow indicator 20 of the invention (again, to be described more fully below), and a dual plane, coaxial swivel breakaway assembly 22', e.g. as described in my U.S. Provisional Patent Application No. 60/117,584, filed Jan. 27, 1999, and entitled "Fuel Dispensing Swivel Breakaway Assembly." The breakaway system 22' is attached to a fuel dispensing, vacuum assist vapor recovery nozzle 26'.

Figure 4:
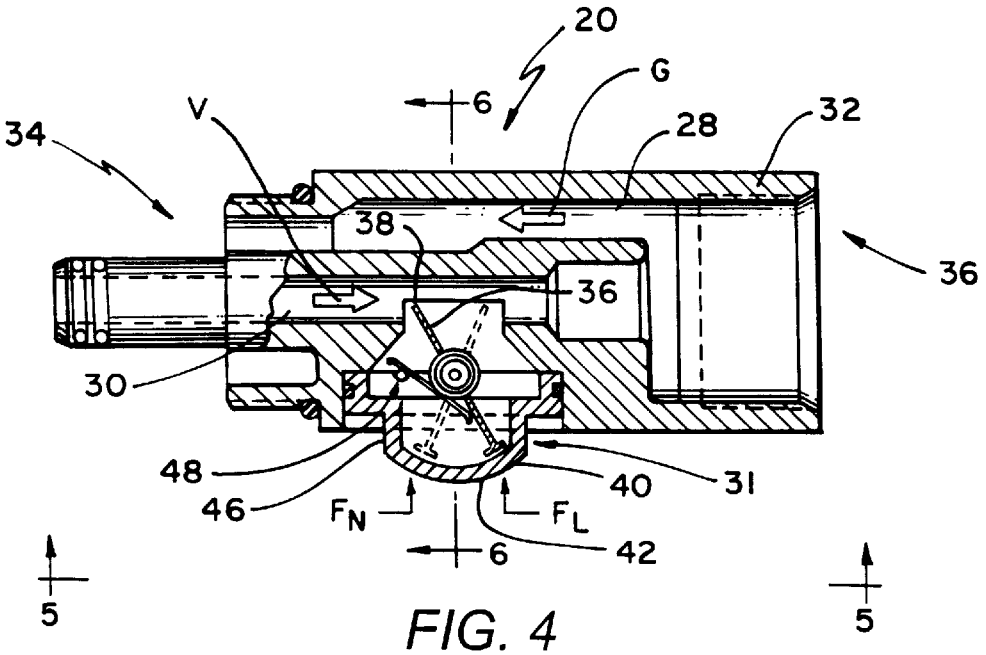
FIG. 4 is a side section view of the coaxial vapor flow indicator of FIG. 1.
Figure 5:
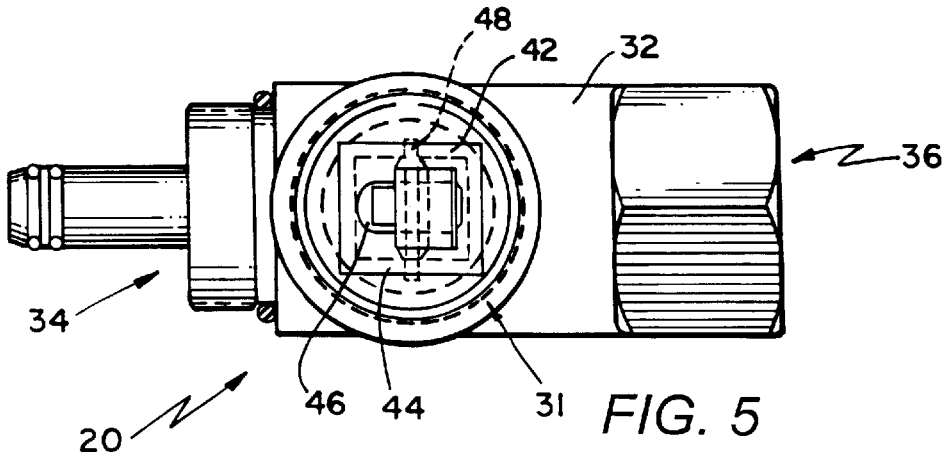
FIG. 5 is a bottom plan view of the coaxial vapor flow indicator of the invention, taken at the line 5—5 of FIG. 4.
Figure 6:
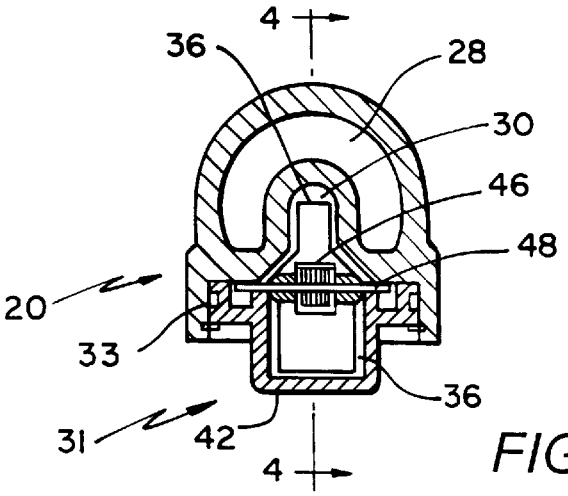
FIG. 6 is an end section view of the coaxial vapor flow indicator of the invention, taken at the line 6—6 of FIG. 4.

Referring next to FIGS. 4–6, in one embodiment, a coaxial vapor flow indicator assembly 20 of the invention consists of a flow indicator module insert 31, with o-ring seal 33, mounted in a one-piece cast metal body structure 32 having a male inverted hose connection 34 at one end and a female connection 36 at the other end. The indicator device 20 is adapted to be threaded into the dispenser side of a coaxial hose breakaway assembly 22 (FIG. 1), or into the dispenser side of a coaxial hose, dual plane, swivel hose breakaway assembly 22' (FIG. 3), or directly into the dispenser side of fuel dispensing nozzle 26, 26'.

The indicator device 20 provides visual indication of vapor flow rate in the inner vapor conduit 30. Referring again to FIGS. 4–6, in this embodiment of a coaxial, vapor flow indicator 20 of the invention, a flow indicator paddle 36 is mounted to pivot on pin 48 between a low flow position, FL (represented in solid line in FIG. 4) and a high flow position, FH (represented in dashed line in FIG. 4). The paddle has a first end 38 extending into the vapor flow path 30 and an opposite, second end 40 which is usually enhanced, e.g., by enlargement, to provide a visual indication of vapor flow rate. The indicator end 40 of the paddle is viewed through the transparent cover 42 that has external gradation markings 44 to indicate flow rate. The indicator end 40 of the paddle 36 is biased to the low flow end, FL, of the graduated scale by a torsion spring 46 installed coaxially with the pin 48, which provides a pivot axis for the paddle. The flow-sensing end 38 of the paddle is therefore in its minimum (FL) upstream (solid line) position. As vapor flow increases, force on the flow sensing paddle overcomes the torsion spring force, causing the paddle 36 to rotate about its pivot, toward its high flow (FH) downstream (dashed line) position, until the force applied on the paddle by vapor flow is in balance with the opposing force applied by the torsion spring. The torsion spring design is dictated by the need to indicate flow rates of up to at least 10 gpm (gallons per minute) in order to match the maximum permitted rate of gasoline flow.

Figure 7:
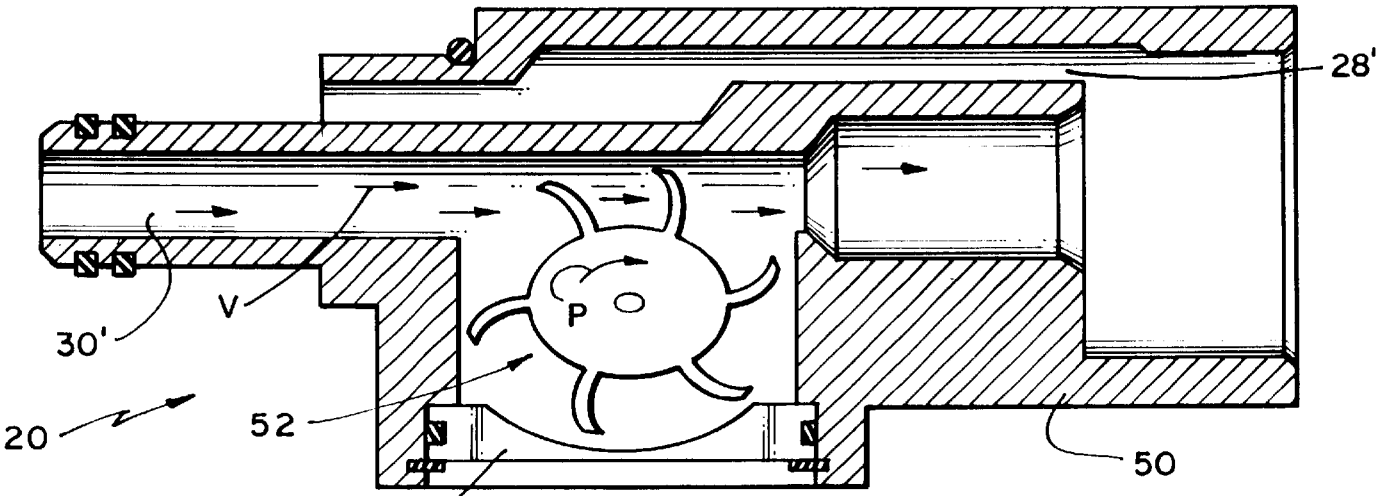
FIG. 7 is a side section view of an alternate embodiment of the coaxial vapor flow indicator of the invention.
Figure 8:
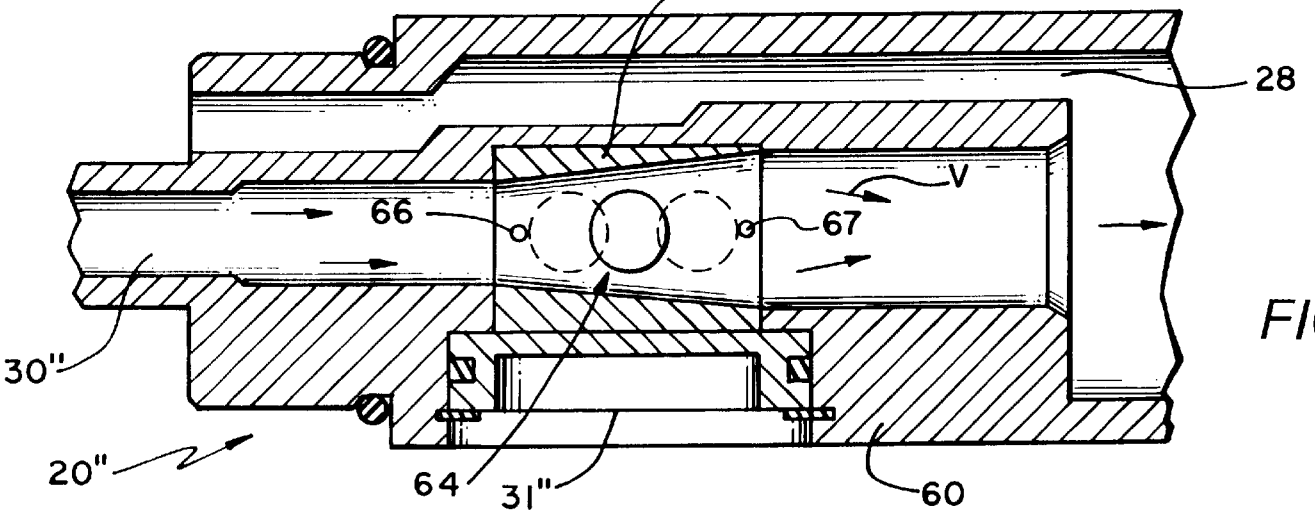
FIG. 8 is a side section view of another alternate embodiment of the coaxial vapor flow indicator of the invention.

Other embodiments of coaxial vapor flow indicators of the invention, e.g., for detection of a kinked vapor hose, are contemplated. These include, in FIG. 7, an indicator assembly 20' with a housing 50 containing a flow indicator module 31' with a paddle wheel 52 mounted to indicate flow without reference to flow rate. In FIG. 8, an indicator assembly 20" suited for vertical mounting has a housing 60 with a flow indicator module 31" containing a float ball rotameter 62 to provide a flow rate reference. The rotameter 62 contains a rotameter-type glass or other precision float ball 64 disposed for movement between pins 66, 67 in response to vapor flow.

The transparent cover flow indicator module, e.g. module 31 (FIG. 4), may be turned 180E in the housing for indicating vapor flow in the opposite direction, e.g., to permit attachment of an indicator device of the invention to the dispenser hose outlet 72 (FIG. 1).

Figure 9:
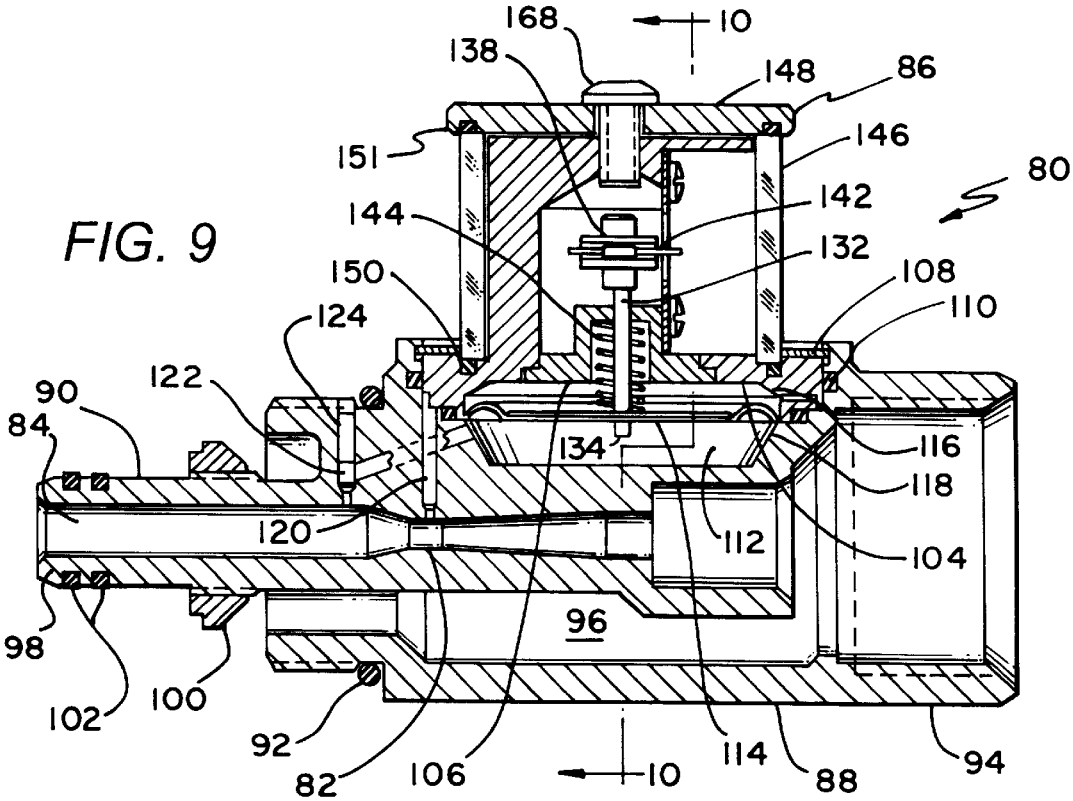
FIG. 9 is a side section view of another embodiment of the coaxial vapor flow indicator of the invention.
Figure 10:
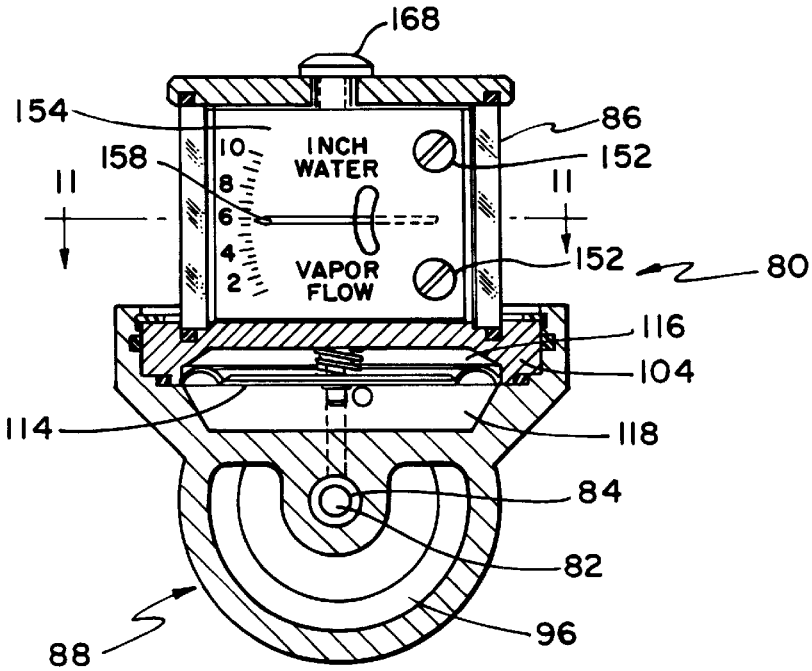
FIG. 10 is an end section view of the coaxial vapor flow indicator of FIG. 9, taken at the line 10—10 of FIG. 9.
Figure 11:
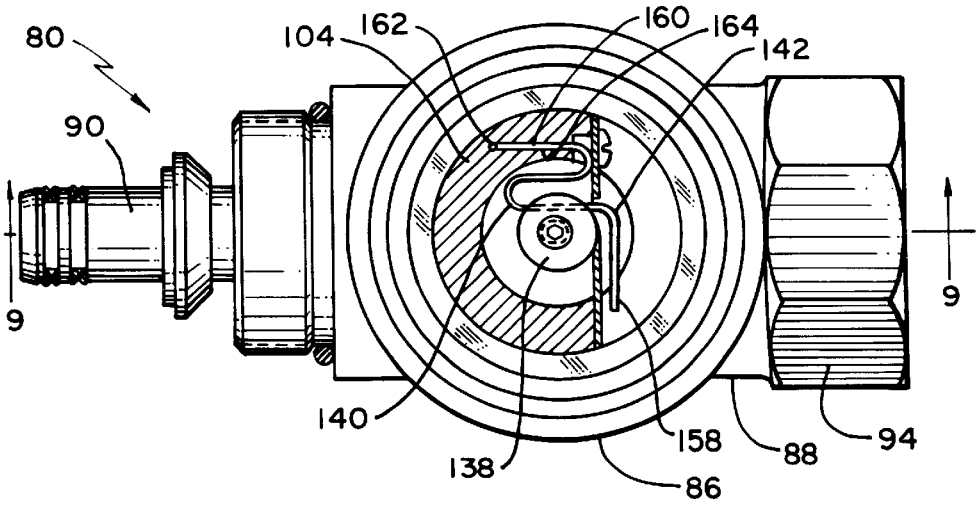
FIG. 11 is a top section view of the coaxial vapor flow indicator of FIG. 9, taken at the line 11—11 of FIG. 10.

Referring next to FIGS. 9–11, according to another preferred embodiment of the invention, a coaxial, vapor flow indicator 80 has a Venturi section 82 formed in the vapor path 84 to provide measurement of pressure differential as an indication of vapor flow rate.

The coaxial vapor flow indicator 80 consists of a flow indicator assembly 86 mounted to a one-piece cast metal body 88. The body has a male, inverted hose, threaded connection 90 (with an o-ring seal 92) and an opposite female threaded connection 94. As above, the indicator device 80 is adapted to be threaded into the dispenser side of a coaxial hose breakaway assembly 22 (FIG. 1), or into the dispenser side of a coaxial hose, dual plane, swivel hose breakaway assembly 22' (FIG. 3), or directly into the dispenser side of fuel dispensing nozzle 26, 26'. The body 88 defines an outer passageway 96 for flow of fuel and the inner, coaxial passageway 84 for flow of vapor, the inner passageway defining the Venturi section 82. The male connection 90 includes an extension 98 defining the inner passageway 84, about which is mounted a spring stop 100, the inner passageway 84 being sealed from outer passageway 96 by quad rings 102.

The flow indicator assembly 86 mounted to the body 88 consists of a diaphragm cover 104 and a spring housing 106, secured to the body by retaining ring 108 and sealed by o-ring 110. The diaphragm cover 104 and spring housing 106, together with body 88, define a cavity 112. A flexible diaphragm 114 secured between the diaphragm cover 104 and the body 88 partitions the cavity 112 into a first chamber 116 (between the flexible diaphragm 114 and the diaphragm cover 104 and spring housing 106) and a second chamber 118 (between the flexible diaphragm 114 and the body 88).

The body 88 further defines a first passageway 120 in communication between the narrow, upstream neck of the Venturi section 82 and the first chamber 116, and a second, branched passageway 122 (with one branch sealed by plug 124) in communication between the vapor passageway at a location upstream of the Venturi section 82 and the second chamber 118. As a result, the position of the flexible diaphragm 114 within the cavity 112 is responsive to and an indication of the differential in pressure between the inlet from the vapor passageway 84 to the first passageway 120 and the inlet from the vapor passageway 84 to the second passageway 122, which in turn is an indication of vapor flow rate in the vapor passageway. The flow indicator assembly 86 includes a shaft 132 which extends through the spring housing 106, with a first end 134 attached to the flexible diaphragm 114 and an opposite, second end to which is mounted adjusting screw assembly 138, secured to the body portion 140 (FIG. 11) of a pointer 142 for indicating vapor flow rate, as described below. A compression spring 144 positioned in the spring housing 106, about the shaft 132, bears between the housing 106 and the flexible diaphragm 114.

The flow indicator assembly 86 further includes a cylindrical lens 146, secured about and upon the diaphragm cover 104 by cover 148, and sealed by o-rings 150, 151. Mounted to diaphragm cover 104 by binder head screws 152, and visible though lens 146, is an indicator plate 154 marked with a vapor flow scale (FIG. 10) which is calibrated in units of vapor flow rate, e.g., in inches of Water Column (WC), as shown, or in gallons per minute or other flow rate units, with flow indicated on the scale by the tip 158 of pointer 142. As seen in FIG. 11, the pointer 142 has a first end portion 160 terminating against a stainless steel ball 162 (acting in the manner of a jewel bearing) press fit within a bore 164 defined by the diaphragm cover 104 and a second, opposite end terminating in tip 158 disposed in front of the scale on indicator plate 154, as viewed through lens 146. The intervening serpentine body portion 140 of the pointer 142 is closely fitted in a circular slot in the second end of the shaft 132, adjacent the adjusting screw assembly 138.

Upon initiation of flow of vapor in the vapor passageway 84, a differential of pressure is established between the first chamber 116 and the second chamber 118, across the flexible diaphragm 114. This differential of pressure acts to displace the flexible diaphragm 114, overcoming the force of the compression spring 144, displacing the shaft 132 (upward in the drawing) and flexing the pointer body 140 attached thereto to move the free end tip 158 of the pointer relative to the scale on the indicator plate 154 visible through the lens 146, thereby providing an indication of vapor flow rate. The position of the pointer tip 158 relative to the scale may be adjusted, e.g. for calibration, by removing the button head screw 168 in the cover 148 and rotating the adjusting screw assembly 138 and the shaft 132. This adjusts the position of the pointer relative to the scale without affecting the position of the diaphragm.

Figure 12:
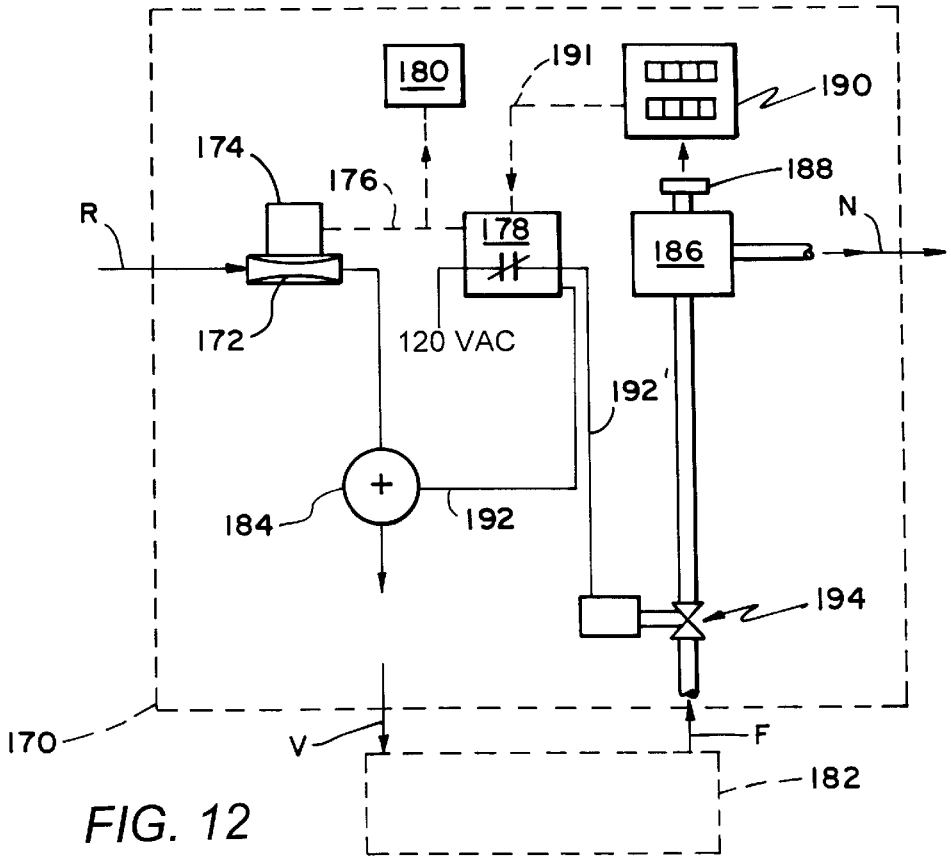
FIG. 12 is a block flow diagram of the flow comparison logic for a gasoline dispenser system with vacuum assist Phase II vapor recovery.

Referring now to FIG. 12, according to another embodiment of the invention, in a gasoline dispensing system 170 with vacuum assist Phase II vapor recovery, a Venturi device 172, e.g., as described above with reference to FIGS. 9—11, is placed in communication with a differential pressure transducer 174 for generating an electrical or other signal 176 proportionate to or otherwise indicative of vapor flow rate, e.g., to be transmitted to a flow comparator 178 and/or to drive an electronic display of vapor flow rate 180.

In general, in a gasoline dispenser system 170 with vacuum assist Phase II vapor recovery system, as shown, liquid fuel (arrow, F) is delivered from an underground storage tank 182 into a vehicle tank (arrow, N) via a nozzle (not shown). The fuel delivered into the vehicle displaces vapor, which is recovered at the nozzle (arrow, R) for return by vapor vacuum pump 184 to the ullage space of the underground tank (arrow, V). The object of the system is to maintain a balance between the volume of fuel removed from the underground storage tank, into the vehicle, and the volume of vapor recovered and delivered into the storage tank as it is displaced from the vehicle tank.

In the system of FIG, 12, vapor returning to the underground storage tank passes through the Venturi section 172, which provides an indication of vapor flow rate through differential pressure monitoring, and results in issue of a signal 176 to the comparator 178. Liquid fuel delivered from the underground storage tank 182 to the nozzle passes through the liquid flow meter 186, which, via pulser 188, indicates liquid flow rate at the electronic flow meter 190, and the flow meter 190 issues a signal 191 of liquid flow rate to the comparator 178. The flow comparator then compares the respective vapor and liquid flow rates. If the vapor-to-liquid ratio is outside predetermined limits, e.g. due to an undetected kink in the vapor return hose or due to failure of the vapor vacuum pump or other vacuum flow control device, the comparator 178 issues a signal 192 to vapor vacuum pump 184 to adjust pump speed in a manner to return the vapor-to-liquid ratio to within the predetermined limits. If adjustment of pump speed fails to return the vapor-to-liquid ratio to within the predetermined limits within a preset period of time, a signal 192' is issued by the comparator 178 to solenoid valve shut-off 194, to shut down the system, thereby to limit escape of vapor to the environment.

A number of embodiments of the invention have been described. Nevertheless, it will be understood that various modifications may be made without departing from the spirit and scope of the invention. For example, in another alternative embodiment of a coaxial, vapor flow indicator of the invention, a proximity sensor may be employed to detect the passing of signal elements mounted to individual blades on the paddle wheel, e.g. of the embodiment of FIG. 7. The signal rate would then allow electronic processing of this information, resulting in a visual display of the flow rate. The comparator 178 may be configured issue the signal 192' to solenoid valve shut-off 194 to shut down the system whenever the vapor-to-liquid ratio is determined to be outside the predetermined limits.

Figure 13:
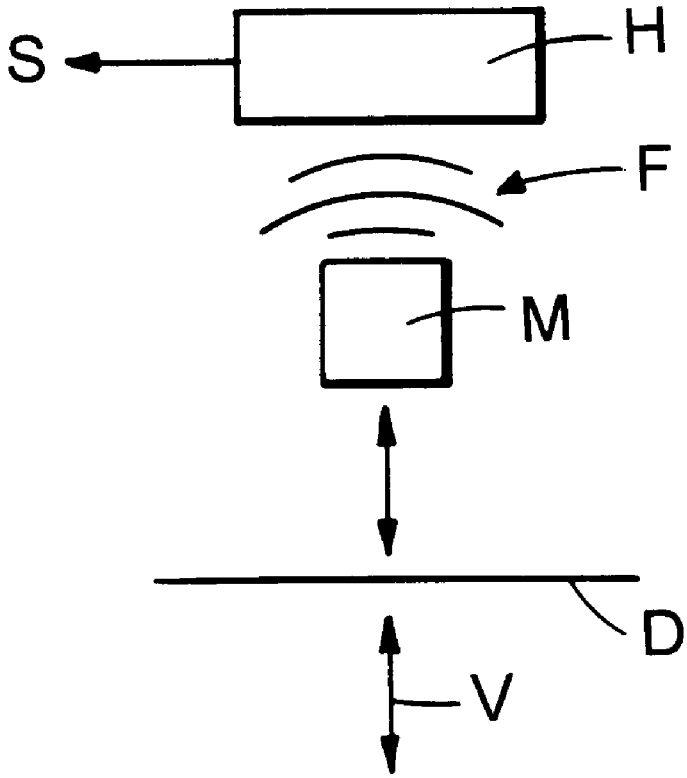
FIG. 13 is a somewhat diagrammatic view of a coaxial vapor flow indicator including a Hall Effect device for measuring magnetic field.

In another embodiment, a detector element of the invention including a Venturi device disposed in communication with the inner vapor conduit and a diaphragm responsive to the pressure between the Venturi throat and the upstream inner vapor passageway, e.g. as shown in FIG. 9 et seq. and described above, may also include a magnet associated with, i.e. reflecting movement of, the diaphragm and an indicator element consisting of a signal indicative of the vapor flow rate issued from a Hall Effect device. Referring to FIG. 13, in this embodiment, movement of the diaphragm, D, in response to changes in pressure, P, between the Venturi throat and the upstream inner vapor passageway, moves an associated magnet, M, relative to Hall Effect device, H, which issues a signal, S, indicative of vapor flow rate, based on measurement of the proximity of the magnetic field, F, e.g. between 0–5 millivolts.

Accordingly, other embodiments are within the scope of the following claims.

What is claimed is:

1. A vacuum assist vapor recovery system for a fuel dispensing system having a coaxial hose with a fuel conduit for delivery of fuel and a vapor conduit for recovery of vapor comprises: an indicator assembly for providing indication of vapor flow reduction in said vapor conduit, said indicator assembly comprising a detector element in communication with said vapor conduit for detection of vapor flow within said vapor conduit and an indicator element of vapor flow for indication of vapor flow and vapor flow reduction within said vapor conduit detected by said detector element, said detector element comprising a Venturi section formed in the vapor conduit, with a first passageway in communication between an inlet to the vapor conduit at a first location at a narrow, upstream neck of the Venturi section and a first chamber and a second passageway in communication between an inlet to the vapor conduit at a second location upstream of the Venturi section and a second chamber, a flexible member disposed between the first chamber in communication with the first location and the second chamber in communication with the second location and responsive to and indicative of differential of pressure between the first location and the second location, which in turn is indicative of vapor flow rate in the vapor conduit, and a magnet associated with, i.e. reflecting the movement of, the flexible member, and said indicator element comprising a Hall Effect sensor for issuing a signal indicative of the vapor flow rate.

2. A fuel dispensing system with a vacuum assisted vapor recovery system having a coaxial hose with a fuel conduit for delivery of fuel and a vapor conduit for recovery of vapor and further comprising an indicator assembly for providing indication of restriction of flow cross-section for the vapor conduit, said indicator assembly comprising a Venturi section formed in the vapor conduit, with a first passageway in communication between an inlet to the vapor conduit at a first location at a narrow, upstream neck of the Venturi section and a first chamber and a second passageway in communication between an inlet to the vapor conduit at a second location upstream of the Venturi section and a second chamber, a flexible member disposed between the first chamber in communication with the first location and the second chamber in communication with the second location and responsive to and indicative of differential of pressure between the first location and the second location, which in turn is indicative of vapor flow rate in the vapor conduit, and a magnet associated with, i.e. reflecting the movement of, the flexible member, and said indicator element comprising a Hall Effect sensor for issuing a signal indicative of the vapor flow rate.

* * * * *